United States Patent [19]

Humenay

[11] Patent Number: 5,058,234

[45] Date of Patent: Oct. 22, 1991

[54] DEVICE FOR APPLYING HYGIENIC AND MEDICINAL SUBSTANCE

[76] Inventor: John C. Humenay, 3206 Hirschfield Rd., Spring, Tex. 77373

[21] Appl. No.: 468,925

[22] Filed: Jan. 23, 1990

[51] Int. Cl.[5] ..... A47L 13/16

[52] U.S. Cl. ..... 15/231; 15/208

[58] Field of Search ..... 15/208, 209 R, 209 B, 15/209 D, 231

[56] References Cited

U.S. PATENT DOCUMENTS

| | | | |
|---|---|---|---|
| 1,287,628 | 12/1918 | Brown | 15/231 |
| 1,863,778 | 6/1932 | Welsh | 15/231 X |
| 2,100,477 | 11/1937 | Fritz et al. | 15/231 |
| 2,172,676 | 9/1939 | Griffith | 15/231 |
| 2,414,321 | 1/1947 | Miller | 15/231 X |
| 2,456,782 | 12/1948 | Hartman | 15/231 |
| 2,710,420 | 6/1955 | Granat et al. | 15/118 |
| 2,726,418 | 12/1955 | Hempel | 15/210 |
| 2,736,913 | 3/1956 | Mirth . | |
| 2,740,150 | 4/1956 | Wilding | 15/231 |
| 3,089,181 | 5/1963 | Hess . | |
| 3,488,126 | 1/1970 | Avallone | 401/8 |
| 3,571,837 | 3/1971 | Weaver | 15/231 |
| 4,008,968 | 2/1977 | Hobbs | 401/207 |
| 4,047,259 | 9/1977 | Lotis | 15/104.92 |
| 4,171,171 | 10/1979 | Jones | 401/150 |
| 4,184,221 | 1/1980 | Edwards | 15/114 |
| 4,475,836 | 10/1984 | Colognoni | 401/201 |

*Primary Examiner*—Chris K. Moore

*Attorney, Agent, or Firm*—Harrison & Egbert

[57] ABSTRACT

A device for applying hygienic and medicinal substances comprising a curved handle, a washing pad holder connected to the curved handle for receiving a cloth, and a cloth fastened to the washing pad holder such that a working surface of the washing pad holder is positioned adjacent to the cloth. A grip portion of +-shaped configuration is fastened to the end of the curved handle opposite the washing pad holder. A hook is connected to the end of the grip portion. The washing pad holder comprises a frame fixedly connected to the end of the handle opposite the grip portion and a depression pan releasably fastened within the frame. The depression pan has a border area of rectangular configuration in surface-to-surface contact with the frame. The frame includes a suitable clip for releasably retaining the depression pan within the frame. The cloth extends over the working surface of the depression pan and is interposed between the depression pan and the frame. A threaded member is connected to the opposite side of the working surface for the receipt of a threaded section of a supply container.

13 Claims, 4 Drawing Sheets

DEVICE FOR APPLYING HYGIENIC AND MEDICINAL SUBSTANCE

TECHNICAL FIELD

The present invention relates to apparatus for the application of hygienic and medicinal substances to the back of a human being.

BACKGROUND ART

It is frequently necessary for a person to apply lotion or other material to his back. This is usually very difficult, often requiring assistance by another person. Also, this problem may arise with respect to other relatively inaccessible portions of the body, particularly for elderly or handicapped persons.

At present, it is very difficult for persons to effectively wash their backs, or to apply a medicament, if they are arthritic, or have limited mobility in the shoulder area. In many situations, it is necessary for such a person to apply soap directly to the bathtub wall and to rub his back on the wall. Many brushes, and other applicators, have handles that make it difficult for the handicapped person to adequately manipulate the brush so as to accomplish the desired purpose. Many times, even those brushes that have curved handles are curved at such an angle as to be ineffective in providing great assistance to the handicapped individual.

In the past, there has been great difficulty where it is desired to use a washcloth for the purpose of cleaning one's back. It is known that brushes exist, but such brushes are ineffective for certain cleaning purposes. Also, brushes are generally ineffective for the application of medicament to one's back. It becomes nearly impossible for one to attach a cloth to a brush so as to accomplish the desired purposes. In addition, many handles for such brushes are difficult to grip by the arthritic and/or handicapped individual.

There are various prior art patents that describe applicators, brushes, and cleaning devices for the human back.

U.S. Pat. No. 4,381,766, issued on May 3, 1983, to A.M. Avolio describes a back applicator having a curved handle. In this device, the desired lotion, creme, oil, or other medicament may be applied onto the pad. The applicator is equipped with a free-floating pad that conforms to the back as it is moved over the back. The handle of the device includes a knurled surface.

U.S. Pat. No. 3,568,237, issued on Mar. 9, 1971, to W.L. Rhodes describes a sponge back washer having a rectangular base with upstanding flanges on each end. The flanges on the long edges extend inwardly into cooperative slits on a cellulose sponge which is located on the base between the upstanding flanges. It is provided with a curved handle that is pivotally secured to the base face of the base and is extendible to a position forwardly of the forward base of the sponge.

U.S. Pat. No. 4,508,108, issued on Apr. 2, 1985, to E. Miyaoka is a brush-massager device having an extensible handle wherein the handle is slidably mounted within a tunnel defined by a disk support unit which supports the massaging face of the device.

U.S. Pat. No. 2,736,913, issued on Mar. 6, 1956, to H. Mirth describes a back scrubber having a rubber head with a sponge rubber pad attached thereto. A soap receiving opening is providing in the center and includes a plunger that is actuable so as to press the soap and rubber pad in firm contact with a washcloth. The handle of this device is curved at one end portion. The grip portion of the handle is relatively flat.

U.S. Pat. No. 2,710,420, issued on June 14, 1955, to F.P. Granat et al. shows a combined scraper and soap foam applicator for dishwashing. This device, having a straight handle includes a rectangular frame portion that receives a scrapper or other porous material.

U.S. Pat. No. 4,184,221, issued on Jan. 22, 1980, to E.G. Edwards describes a bath brush having an elongated continuously curved member that terminates in a handle at one end and a brush arrangement at the other end. The brush arrangement includes an enlarged head formed of a substantially planar surface from which extends a plurality of bristles. A pair of clips are provided adjacent to the bristles for removably holding a face cloth. This face cloth may cover the bristles so as to facilitate bathing with the brush.

It is an object of the present invention to provide a device that facilitates the washing of one's back.

It is another object of the present invention to provide a device that allows a face cloth to be removably attached for washing purposes.

It is another object of the present invention to provide a device that has a handle of proper curvature for proper over-the-shoulder usage.

It is still another object of the present invention to provide a washing device and/or medicinal applicator having a gripping portion suitable for handicapped usage.

It is still another and further object of the present invention to provide a body back washing and medicinal applicator device that allows medicament and hygienic material to be selectively dispensed onto a face cloth during usage.

These and other objects and advantages of the present invention will become apparent from a reading of the attached specification and appended claims.

SUMMARY OF THE INVENTION

The present invention is a device for applying hygienic and medicinal substances that comprises a curved handle, a washing pad holder that is connected to the curved handle, and a cloth that is fastened to the washing pad holder such that the cloth is positioned over a working surface on the washing pad holder.

The curved handle comprises a member having a radius of curvature of between fourteen inches and eighteen inches. The curved handle includes a grip portion of +-shaped figure cross-section at the end of the curved handle opposite the washing pad holder. The grip portion is angularly offset by between eight and ten degrees from the curved handle. The washing pad holder is also angularly offset by eight to ten degrees from the curved handle. A hook is connected to the grip portion at the end opposite the curved handle.

The washing pad holder comprises a frame that is fixedly connected to the handle and has a rectangular opening therein, and a depression pan releasably fastened within the rectangular opening of the frame. The depression pan has a flat working surface thereon. The depression pan has a border area of rectangular configuration positioned in surface-to-surface contact with the frame. The frame includes a clip for releasably retaining this border area in the surface-to-surface contact. The depression pan extends downwardly through the frame from this border area. The cloth extends between the depression pan and the frame so as to cover the working surface. The frame has a first clip on the end of the frame opposite the handle for sliding engagement with the border area of the depression pan. A second clip is rotatably fastened to the frame such that the rotation of the clip allows the depression pan to be fixed in position on the frame. The depression pan includes a suitable supply container receiver that is affixed to the opposite side of the working surface. This supply container receiver is a threaded member that is suitable for connection to the threads of a medicinal or hygienic liquid container. When the container is threadedly connected to this threaded member, medicament may be dispensed from the container so as to pass to the cloth over the working surface of the depression pan.

DETAILED DESCRIPTION OF THE INVENTION

Figure 1:
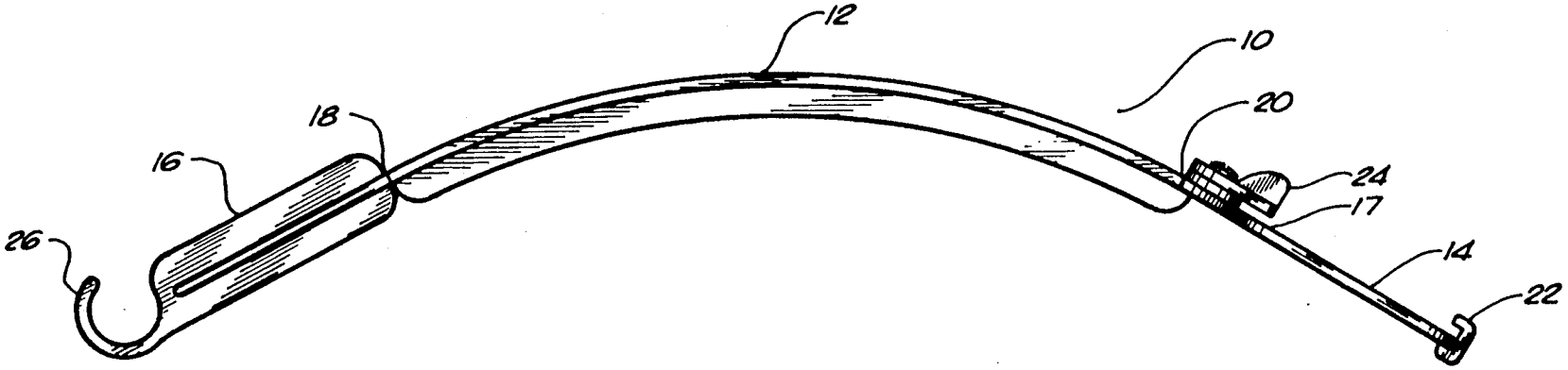
FIG. 1 is a view in side elevation of the curved handle, grip portion, and frame of the present invention.

Referring to FIG. 1 there is shown at 10 the device for applying hygienic and medicinal substances to the back of a human being. Device 10 comprises a curved handle 12, a washing pad holder 14, and a grip portion 16. The washing pad holder 14 is illustrated in FIGURE 1 without a depression pan and cloth affixed thereto. The depression pan and cloth are illustrated in greater detail in connection with FIGS. 3 and 4. The curved handle 12 is particularly designed so as to enhance the ability to apply hygienic and medicinal substances to a human back. The curve allows persons of arthritic and handicapped condition to properly extend the device 10 over their shoulders and onto their back. As such, curved handle 12 is designed so as to have a radius of curvature of between fourteen inches and eighteen inches. In the preferred embodiment of the present invention, such radius is fifteen and one-half inches. After experimentation, it was found that the optimum degree of curvature would be between fourteen and eighteen inches. Curved handle 12 may be made of any plastic material. The handle 12 should not be made of rigid materials or of high tensile materials that will fracture or break into sharp protrusions. It is desirable that the material of handle 12 be flexible and withstand breakage if it is dropped or used as a balance aid. The handle 12 is made of a plastic that is able to bend and return to its original shape.

The washing pad holder 14, as illustrated in FIG. 1, is a frame 17 that is connected at 20 to one end of curved handle 12. Frame 17 includes a first clip 22 and a second clip 24 at opposing ends of frame 17 of washing pad holder 14. First clip 22 is located at the end of device 10 and serves to slidably receive an edge of the depression pan (to be described hereinafter). Second clip 24 is a clip that is rotatably fastened to the frame 17, opposite the first clip 22, such that the rotation of the clip 24 will affix the depression pan in proper position within frame 14. Although frame 14 is a straight member, it is necessary to achieve the proper curvature so as to assist the person in the proper application of medicinal and hygienic materials to their back. As such, an eight degree to ten degree bend is achieved at the junction 20 between the frame 14 and curved handle 12.

Figure 7:
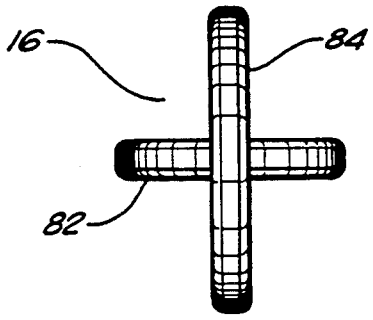
FIG. 7 is an end view showing the configuration of the grip portion of the present invention.

Grip portion 16 is connected to end 18 of curved handle 12. Grip portion 16 is specially designed so as to accommodate the needs of arthritic or handicapped patients. As can be seen in FIG. 7, grip portion 16 has a +-shaped configuration. It has been found, after experimentation, that smooth, or round shapes, are difficult to grip by those having arthritic hands. In the wet environment of a bathtub, these problems are further exacerbated for the handicapped individual. It was found that a +-shaped cross-section for the grip portion 16 was ultimately preferable over other designs. It can be seen that grip portion 16 is a straight member. In order to accommodate the requirements for a curved handle 12, the grip portion 16 is angularly offset by eight to ten degrees at the junction 18 between the grip portion 16 and the curved handle 12. A hook 26 is connected to the end of the grip portion 16 opposite the curved handle 12. The hook 26 allows the user to hang the device 10 from any desired location. Since hook 26 is a rigid member that is integrally formed with the grip portion 16, it can serve as additional leverage t o the user of the device 10.

As described herein, the device 10 is stated as having separate parts, i.e., the curved handle 12, the frame 14, and the grip portion 16. This is not an ultimate requirement of the present invention. The entire device 10 can be integrally formed by suitable plastic molding processes. Alternatively, the separate components can be joined together and sealed in standard fashion. The distinctness of these components is not intended as a limitation of the present invention.

Figure 2:
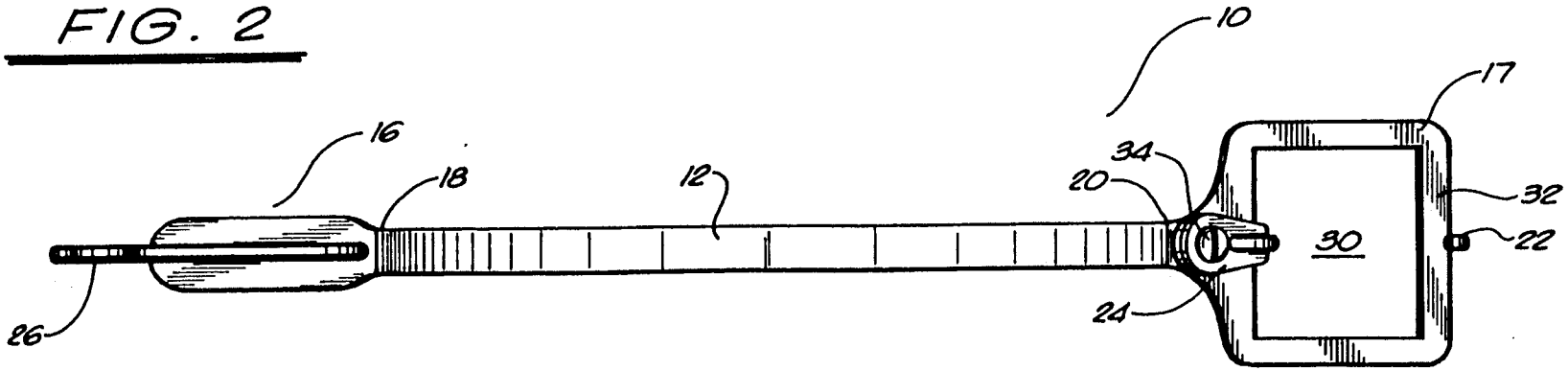
FIG. 2 is a top view of the grip portion, the curved handle, and the frame of the present invention.

FIG. 2 illustrates a top view of device 10. In particular, it can be seen that the curved handle 12 is a longitudinal member having a relatively wide surface. The width of curved handle 12 is designed so as to provide sufficient strength to accommodate the normal use of the device 10. It can be seen in FIG. 2 that frame 17 extends outwardly from the end 20 of curved handle 12. Frame 17 has a generally rectangular configuration and a rectangular opening 30. Rectangular opening 30 will receive a depression pan (to be described hereinafter). The depression pan will lay in surface-to-surface contact with the edge 32 of frame 17. Clip 22 is located in the central portion of the end of device 10. Similarly, the second clip 24 has an oblong configuration and is rotatably mounted about a pin 34. Pin 34 is joined to the surface of the frame 17. The clip 24 will rotate about pin 34 so as to affix the depression pan in proper position within the rectangular opening 30 of frame 17. Grip portion 16 extends outwardly from end 18 of curved handle 12. It can be seen that the hook 26 extends outwardly from the end of the grip portion 16.

Figure 3:
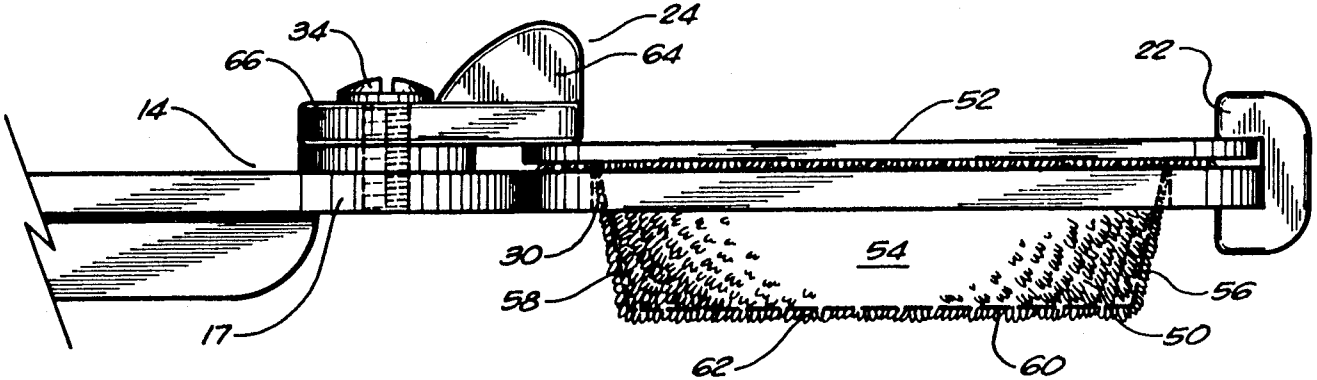
FIG. 3 is a side view showing the configuration of the depression pan as contained within the frame.

FIG. 3 is a detailed view showing the configuration of the depression pan 50 in accordance with the preferred embodiment of the present invention. FIG. 3 is an isolated view showing the configuration of the washing pad holder 14. The depression pan 50 includes a border area 52 that forms the upper surface of depression pan 50. Border area 52 is affixed in position adjacent to the top surface of the frame 17. The downwardly extending pan portion 54 passes through the rectangular opening 30 of frame 17. As can be seen, depression pan 54 has inwardly angled side walls 56 and 58. The side walls 56 and 58 angle downwardly to the flat working surface 60. Flat working surface 60 is a flat rectangular area that provides the proper surface shape for allowing the application of medicinal and hygienic substances. As can be seen in FIG. 3, cloth 62 extends downwardly along the side walls 56 and 58 and extends across the working surface 60 of depression pan 50. Cloth 62 is typically a face cloth, or other material, that may be removed and reused as desired.

The border area 52 is fitted within first clip 22 and retained by second clip 24. It can be seen in FIG. 3 that first clip 22 has a C-shaped configuration. The bottom portion of C-shaped clip 22 is fastened to the bottom of the frame 17. The top portion of the C-shaped clip 22 receives the end of the border area 52 of depression pan 50. The second clip 24 has a projecting area 64 that is particularly designed for use by handicapped individuals. The rotational movement of the projecting portion 64 of member 66 around pin 34 allows the border area 52 of depression pan 50 to be properly affixed in position.

Figure 4:
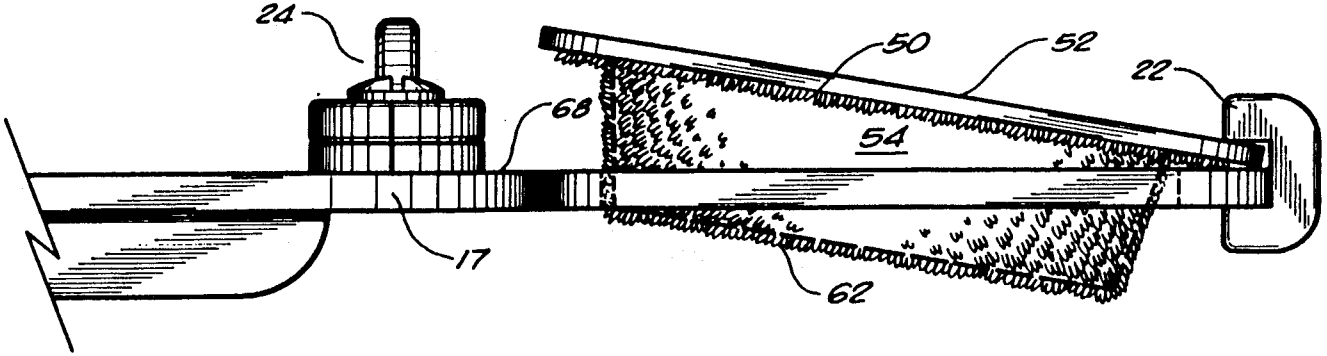
FIG. 4 illustrates the manner in which the depression pan is received by the clips on the frame.

FIG. 4 illustrates the manner in which the depression pan 50 is fitted within the frame 17. Initially, the border area 52 is slidably received by the opening of C-shaped clip 22. When the edge 52 is slidably received by the clip 22, the depression pan 50 may be angularly lowered through the rectangular opening of frame 17, in the manner illustrated. The cloth 62 is maintained in position surrounding the pan portion 54 of depression pan 50. When the angular lowering of the depression pan 50 is completed, the border area 52 will abut the top surface 68 of frame 17. Clip 24 can then be rotated so as to engage the border area in the manner illustrated in FIG. 3.

The depression pan 50 may be thermoformed or manufactured by blown extrusion. Typically, the depression pan will be made of a polyethylene material.

Figure 5:
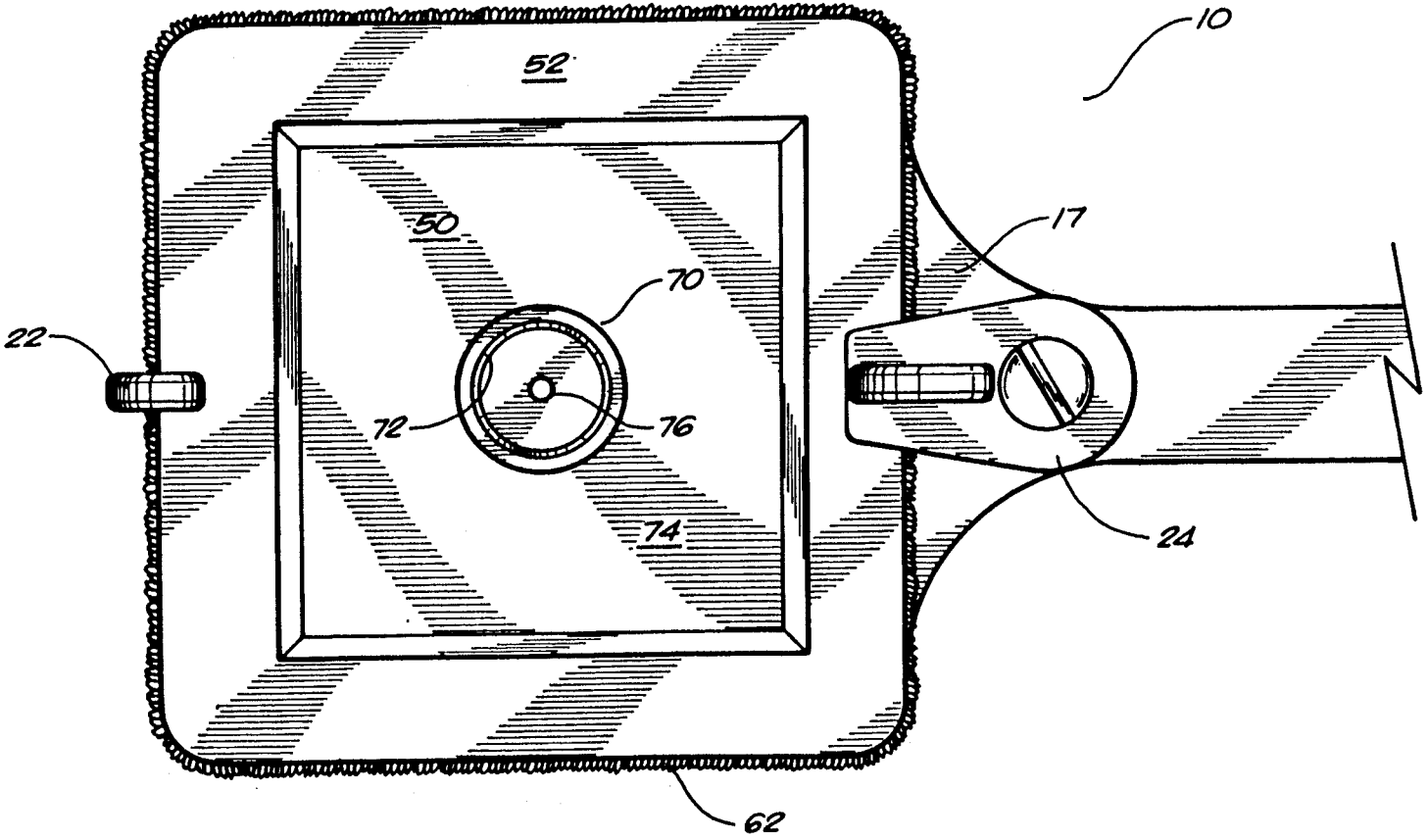
FIG. 5 is a top view showing the arrangement of the depression pan on the frame.

FIG. 5 is a top view showing the manner in which the depression pan 50 is received by the frame 17 of device 10. Specifically, the depression pan 50 has a square, or rectangular configuration. The border area 52 is of consistent shape and dimension throughout the periphery of depression pan 50. Cloth 62 extends outwardly beyond the edges of the border area 52 of depression pan 50. As was described hereinbefore, the cloth 62 will be interposed between the depression pan 50 and the frame 17. It can be seen in FIGURE S that the first clip 22 slidably engages the surface of border area 52. Similarly, the second clip 24 engages the surface of border area 52. The pan area of depression pan 50 is a generally square, or rectangular, area. Of particular note is the supply container receiver 70. The supply container receiver 70 is a threaded member 72 of circular configuration that is positioned in the bottom 74 of depression pan 50. Specifically, the supply container receiver 70 is positioned on the opposite side of the working surface 60 of the depression pan 50. The threaded member 72 has a plurality of female threads that will engage the male threads of the supply container. An aperture 76 extends through the working surface 60 of the depression pan 50 so as to communicate between the supply container (inserted within the receiver 70) and the cloth 62. This allows a medicament supply container to be threadedly attached. The supply container can then selectively dispense suitable medicament or hygienic materials onto cloth 62. The typical supply containers that will be inserted into the receivers 70 will be those containers of polyethylene material. These polyethylene supply containers will retain the shape and will dispense material as needed. Typically, these containers will have a three-quarter inch threaded top. This threaded top may be used to engage the threads of threaded member 70. The supply container can contain liquid soap that flows through the aperture 76 and onto the washcloth 62. Washcloth 62 can be used to hold both liquid or balm medication so as to allow the application to areas under stress. If soap is used, then a complete washing of the back can be accomplished without requiring the soaping of the washcloth. Any medicine of liquid form can be metered through the aperture 76 and onto the washcloth. Balms or ointment can be applied to the washcloth and then rubbed onto the affected area that requires relief. This allows the user to be independent in his needs. The present device can be used whenever treatment is necessary.

Figure 6:
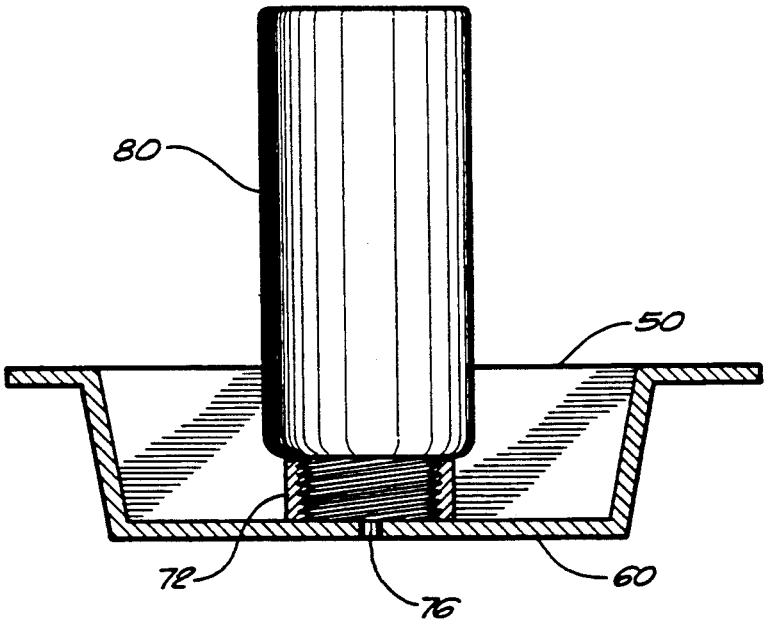
FIG. 6 shows the arrangement by which a supply container may be attached to the depression pan.

FIG. 6 illustrates how supply container 80 is affixed to the threaded member 72. The supply container 80 has a threaded area that is received by the threads of threaded member 72. Any ointment, balm, medication or soap can pass from the supply container 80 through the aperture 76 and onto the wet washcloth extending around the working surface 60. The supply container 80 can be attached to the threaded member 72 prior to the installation of the depression pan 50 within the frame 17 of the device 10. Alternatively, the depression pan 50 can be installed and then the supply container 80 can be attached. The installation procedure is at the discretion of the user.

FIG. 7 illustrates a +−shaped configuration of the grip portion 16 of the present invention. It can be seen that the grip portion 16 includes a horizontal member 82 and a vertical member 84. The configuration of the grip portion 16 can be molded by known technology. After experimentation, it has been found that this +-shaped configuration is the optimum design for use by those of limited gripping ability.

The present invention, in its embodiments, offers significant improvements over prior devices. First, and foremost, the present invention allows those handicapped or arthritic individuals to properly tend to the needs of their back. The ideal shape of the handle of the device, in combination with the configuration of the washcloth, allows the proper application of medicinal and hygienic substances. The present invention takes very little time to master. The simple two-part structure is not complicated to assemble. The device can be used to wash the back extremities never before reached by people. The present invention allows the user to be independent in his needs. The device can be used whenever treatment is necessary. This gives the user freedom to apply the medication without the help usually needed by such individuals. The washcloth can be washed and used again many times just as regular towels and washcloths are used. The present invention provides a means for reaching and washing the back from over the shoulder from both sides with little effort or discomfort. As such, the present invention offers significant advantages to the user.

The foregoing disclosure and description of the invention is illustrative and explanatory thereof, and various changes in the details of the illustrated apparatus can be made within the scope of the appended claims without departing from the spirit of the invention. The present invention should be only limited by the following claims and their legal equivalents.

I claim:

1. An implement comprising:

a curved handle having a radius of curvature of between 14 inches and 16 inches, said curved handle having a grip portion fastened to one end of said curved handle;

a washing pad holder connected to said curved handle opposite said grip portion, said washing pad holder releasably receiving a cloth, said washing pad holder having a generally flat working surface, said grip portion being angularly offset between eight and ten degrees inwardly from said curved handle toward said flat working surface; and a cloth fastened to said washing pad holder such that said working surface is positioned adjacent to said cloth.

2. The apparatus of claim 1, said grip portion having a +-shaped cross-section.

3. The apparatus of claim 1, further comprising:

a hook connected to the end of said grip portion opposite said curved handle.

4. The apparatus of claim 1, said washing pad holder comprising:

a frame fixedly connected to said handle, said frame having a rectangular opening therein; and a depression pan releasably fastened within said rectangular opening of said frame, said depression pan having a working surface formed thereon.

5. The apparatus of claim 4, said depression pan comprising:

a border area of rectangular configuration, said border area being in surface-to-surface contact with said frame, said frame having a clip for releasably retaining said border area in contact with said frame.

6. The apparatus of claim 5, said depression pan extending downwardly through said frame from said border area, said cloth extending between said depression pan and said frame.

7. The apparatus of claim 5, said frame having a first clip on the end of said frame opposite said handle, said first clip for sliding engagement with said border area of said depression pan, and a second clip rotatably fastened to said frame, the rotation of said clip for fixing said depression pan in position on said frame.

8. An implement comprising:

a curved handle having a grip portion on one end, said curved handle having a radius of curvature of between 14 inches and 16 inches;

a frame formed on the end of said curved handle opposite said grip portion; and a depression pan releasably fastened to said frame, said depression pan defining a working surface thereon, said grip portion being angularly offset between eight and ten degrees inwardly from said curved handle toward said working surface.

9. The applicator of claim 8 said grip portion having a +-shaped cross-section.

10. The applicator of claim 8 said frame having a rectangular opening for receiving said depression pan, said frame having clip fastened thereto for releasably attaching said depression pan to said frame.

11. The applicator of claim 8 said depression pan comprising:

a border area of rectangular configuration, said border area being in surface-to-surface contact with said frame, said frame having clip thereon for releasably retaining said border area in surface-to-surface contact with said frame.

12. The applicator of claim 8, further comprising:

a cloth interposed between said frame and said depression pan, said cloth extending over said working surface.

13. A body back washing aid comprising:

a curved handle having a radius of curvature of between fourteen inches and eighteen inches;

a grip portion connected to said handle and angularly offset from said handle by eight to ten degrees;

a frame member connected to the end of said curved handle opposite said grip portion, said frame member being angularly offset by eight to ten degrees from said curved handle, said grip portion being angularly offset inwardly toward said handle;

said frame member being angularly offset outwardly away from said handle; and a depression pan releasably fastened to said frame member, said depression pan defining a working surface thereon.

* * * * *